US007505698B2

(12) United States Patent
Morimoto

(10) Patent No.: US 7,505,698 B2
(45) Date of Patent: Mar. 17, 2009

(54) IMAGE FORMATION DEVICE AND CARTRIDGE WHICH USES VERIFICATION DATA STORED IN A MEMORY OF THE CARTRIDGE

(75) Inventor: Ryohta Morimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 115 days.

(21) Appl. No.: 11/354,109

(22) Filed: Feb. 15, 2006

(65) Prior Publication Data

US 2006/0193642 A1 Aug. 31, 2006

(30) Foreign Application Priority Data

Feb. 21, 2005 (JP) ..... 2005-044526

(51) Int. Cl.
*G03G 15/00* (2006.01)

(52) U.S. Cl. ..... 399/12; 399/13

(58) Field of Classification Search ..... 399/12, 399/13, 27, 30, 61, 62
See application file for complete search history.

(56) References Cited

U.S. PATENT DOCUMENTS 6,591,070 B1 * 7/2003 Shoji et al. ..... 399/27

FOREIGN PATENT DOCUMENTS

| | | |
|---|---|---|
| CN | 1083189 C | 4/2002 |
| CN | 1119716 C | 8/2003 |
| CN | 1144107 C | 3/2004 |
| JP | 2001-356967 | 12/2001 |
| JP | 2002-207401 | 7/2002 |

OTHER PUBLICATIONS

Wu Changming, et al., "Design of Data Communication System Implemented Through Radio Channels" Journal of Beijing Institute of Technology, vol. 14, issue 1, Feb. 28, 1994, pp. 59-63.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image formation device is disclosed that is able to detect data errors each time data are read from a memory in a cartridge and able to detect transmission error of the data. The image formation device includes a cartridge memory controller and a verification unit to verify reliability of data read from the memory of the cartridge. The cartridge reads both predetermined data and verification data stored in the memory unit, and sends the predetermined data and verification data to the image formation device; the verification unit compares the read-out verification data to verification data stored in a main body of the image formation device to verify reliability of the data read from the memory unit.

12 Claims, 11 Drawing Sheets

FIG.10A

Error is detected between toner cartridge and host.
Please remove toner cartridge, clean contact point to the host, and set the toner cartridge again.

OK

FIG.10B

Error is detected between toner cartridge and host.
Please remove toner cartridge, and set the toner cartridge again.

OK

IMAGE FORMATION DEVICE AND CARTRIDGE WHICH USES VERIFICATION DATA STORED IN A MEMORY OF THE CARTRIDGE

BACKGROUND OF THE INVENTION

1. Field of the Invention

The present invention relates to an image formation device and a cartridge detachably attached to the image formation device.

2. Description of the Related Art

In the related art, an image development unit, an image transfer unit, an image cleaning unit and other units are integrated together and the integral piece can be attached to or detached from the main body of an image formation device, which makes maintenance of the image formation device easy. This is called "image formation device with a process cartridge". Here, the process cartridge is the integral piece of the image development unit, the image transfer unit, the image cleaning unit, and a photoconductor, and this process cartridge is attached to or detached from the main body of the image formation device.

In the above image formation device, a non-volatile memory is installed in the process cartridge; the image formation device writes information of the process cartridge and information of the units in the process cartridge in the non-volatile memory, and the image formation device reads the information from the non-volatile memory to control operations of the image formation device.

In the related art, for example, the image formation device can write data to or read data from the non-volatile memory in the process cartridge in the following way. Once the process cartridge is attached to the image formation device, a control line for the non-volatile memory in the process cartridge is connected to a control line from a controller of the image formation device, and the controller of the image formation device enables write and read operations on the non-volatile memory.

In this method, however, toner contamination at contact points may cause faulty contact, and further cause connection failure of transmission lines between the main body of the image formation device and the non-volatile memory in the process cartridge, resulting in transmission failure of data to be written in the non-volatile memory or data read from the non-volatile memory.

In addition, in the related art, usually, due to the detachably attached process cartridge, the portion of the process cartridge where the non-volatile memory is arranged is movable relative to the main body of the image formation device, and the main body of the image formation device is configured to be able to issue commands to a control unit of the process cartridge, for example, by using RFID (Radio Frequency IDentification), which allows wireless communications to receive data from the non-volatile memory of the process cartridge or transmit data to the non-volatile memory of the process cartridge.

In this method, however, because of limitations of the communications distance and directional characteristics, transmission failure may occur for data to be written in the non-volatile memory or data read from the non-volatile memory of the process cartridge.

For example, Japanese Laid-Open Patent Application No. 2001-356967 (referred to as "reference 1" hereinafter) discloses a device in which when errors of information of a pointer indicating a position of writing data at the time of power on are detected, addresses having been written to over a limit number are checked, and once an address having not been written to over the limit number is found, data are written to that address, to thus restore the pointer information.

In addition, Japanese Laid-Open Patent Application No. 2002-207401 (referred to as "reference 2" hereinafter) discloses a device in which after the process cartridge is detached from the main body of the image formation device, data stored in a memory in the main body beforehand are compared to data stored in the process cartridge, and when serial numbers are the same, but the other data are abnormal, it is determined that these data in the process cartridge are errors written in a period of disconnection, and then data stored in a memory of the main body are read into the process cartridge to restore the data.

However, although the techniques disclosed in reference 1 and reference 2 allow verification of correctness of the data stored in the memory in the process cartridge when the image formation device is powered on or when the process cartridge is attached to the image formation device, they cannot detect malfunctions in control lines or in communication units nor errors in read operations occurring after that.

SUMMARY OF THE INVENTION

A general object of the present invention is to solve one or more problems of the related art.

A specific object of the present invention is to provide an image formation device and a cartridge detachably attached to the image formation device, which is able to detect data errors each time data are read from a memory in the cartridge, and able to detect transmission errors when transmitting the data.

According to a first aspect of the present invention, there is provided an image formation device that reads data from or writes data in a memory unit provided in a cartridge detachably attached to the image formation device, the image formation device comprising a cartridge memory controller configured to control operations of reading data from the memory unit and writing data in the memory unit from a side of the image formation device; and a verification unit configured to verify reliability of the data read from the memory unit according to instructions from the cartridge memory controller, wherein when the cartridge reads predetermined data from the memory unit according to the instructions of the cartridge memory controller, the cartridge reads out both the predetermined data and verification data stored in the memory unit, sends the predetermined data and verification data to the image formation device, and the verification unit compares the verification data read out according to the instructions of the cartridge memory controller to verification data stored in a main body of the image formation device to verify reliability of the data read from the memory unit.

According to an embodiment of the present invention, it is possible to detect data errors each time data are read from the memory unit in the cartridge, and to detect transmission errors.

As an embodiment, the verification data includes data specific to the cartridge stored in the memory unit. Further, when the cartridge is put into use for the first time, the data specific to the cartridge are read out plural times, and the data specific to the cartridge are adopted to be the verification data when data sets read plural times from the cartridge are in agreement with each other.

Alternatively, the verification data are stored at a predetermined position in the memory unit, or the verification data are read from the main body of the image formation device in advance in each read operation.

According to an embodiment of the present invention, it is possible to increase verification precision. When the position of storing the verification data is also used as a parameter in addition to the verification data, it is possible to further increase verification precision.

When the verification data are read from the main body of the image formation device in advance in each read operation, because in each read operation the verification data are read from the main body of the image formation device, are written in the cartridge, and then are read out for data verification, it is possible to further increase verification precision.

As an embodiment, the image formation device further comprises a communication unit that is connected with a communication unit in the cartridge through a communication line, wherein when the read-out verification data are different from the verification data stored in the main body of the image formation device, the cartridge memory controller directs the main body of the image formation device to send the predetermined data and the verification data again to the cartridge via the communication line.

As an embodiment, the communication line is a radio frequency (RF) link.

According to an embodiment of the present invention, the communications between the cartridge and the main body of the image formation device may be wireless communications.

According to a second aspect of the present invention, there is provided a cartridge able to be detachably attached to an image formation device, comprising: a memory unit; a memory controller configured to control operations of reading data from the memory unit and writing data in the memory unit; and a communication unit configured to communicate with a main body of the image formation device; wherein verification data are stored in the memory unit; according to instructions from the main body of the image formation device of reading predetermined data from the memory unit, the memory controller reads out both the predetermined data and the verification data; then the communication unit sends the predetermined data and verification data to the main body of the image formation device.

As an embodiment, when the cartridge receives a response from the main body of the image formation device indicating that the verification data received by the image formation device are different from the verification data stored in the main body of the image formation device, or a message from the main body of the image formation device requesting re-sending the verification data, the cartridge sends the predetermined data and the verification data to the main body of the image formation device again with a different communication condition and a different communications procedure.

As an embodiment, when the cartridge receives a response from the main body of the image formation device indicating that the verification data received by the image formation device are different from the verification data stored in the main body of the image formation device, or a message from the main body of the image formation device requesting re-sending the verification data, the cartridge sends the predetermined data and the verification data to the main body of the image formation device again plural times under the same communications condition.

These and other objects, features, and advantages of the present invention will become more apparent from the following detailed description of preferred embodiments given with reference to the accompanying drawings.

BRIEF DESCRIPTION OF THE DRAWINGS

FIG. 10A and FIG. 10B are examples of messages displayed when the end mark data cannot be read correctly;

DESCRIPTION OF THE PREFERRED EMBODIMENTS

Below, preferred embodiments of the present invention are explained with reference to the accompanying drawings.

Figure 1:
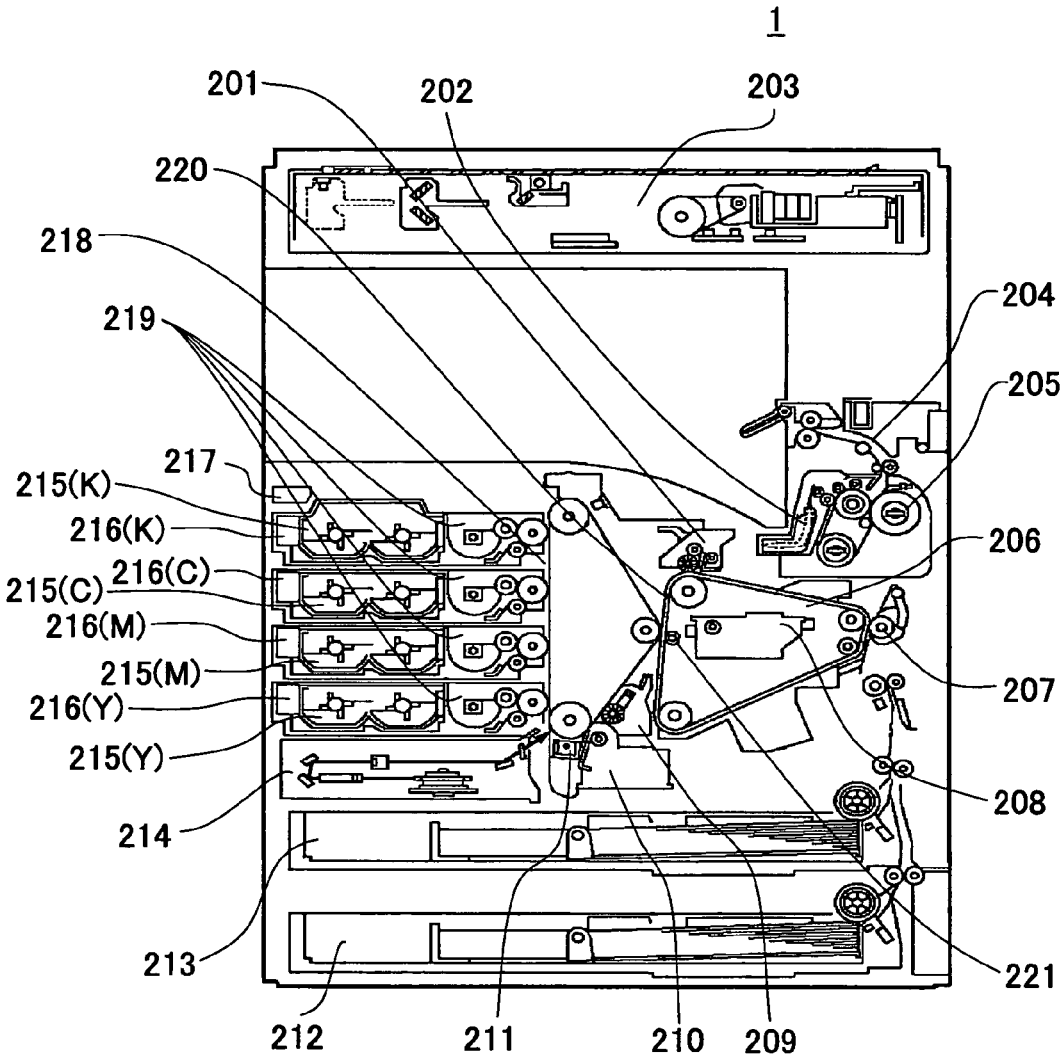
FIG. 1 is a schematic view illustrating a configuration of an image formation device 1 according to an embodiment of the present invention.

FIG. 1 is a schematic view illustrating a configuration of an image formation device 1 according to an embodiment of the present invention.

For example, the image formation device 1 is a copier. When receiving an instruction from a not-illustrated operational panel to start copying, a scanner unit 203 starts to read image data on a manuscript. A write unit 214 writes the thus obtained image data on photoconductors 218 in order of color.

Each of the photoconductor 218 is uniformly charged beforehand by a charging unit 211. The write unit 214 irradiates light on the photoconductors 218, thereby forming electrostatic latent images of different colors on the photoconductors 218. Image developing units 219 corresponding to different colors develop the electrostatic latent images of different colors on the corresponding photoconductors 218, thus forming toner images of different colors on the photoconductors 218.

The toner images of different colors on the photoconductors 218 are transferred to an intermediate transfer belt 220 of an intermediate transfer belt unit 206 by a primary transfer unit 221. The toner images on the intermediate transfer belt 220 are transferred by a secondary transfer unit 207 to paper fed from a first document feed tray 213 or a second document feed tray 212. A fusing unit 205 fuses the toner images on the paper by thermal fusing to fix the toner images on the paper.

Then, the paper with the fused toner images is delivered by a delivery unit 204, thereby producing a copy of the manuscript.

Toner not transferred to the photoconductor 218 or the intermediate transfer belt 220 is removed by a photoconductor cleaning unit 209 or an intermediate transfer belt cleaning unit 201, and is collected in a photoconductor waste toner bottle 210 or an intermediate transfer waste toner bottle 208 as waste toner.

Further, in order to separate sheets with fused images easily, an application unit 202 applies a tiny amount of silicon oil to the fusing unit 205.

In FIG. 1, toner cartridges 215 (Y), 215 (M), 215 (C), and 215 (K) are filled with yellow toner, magenta toner, cyan toner, and black toner, respectively. Each of the toner cartridges 215 (Y), 215 (M), 215 (C), and 215 (K) is furnished with one of the above-mentioned developing units 219, hence the toner cartridges 215 (Y), 215 (M), 215 (C), and 215 (K) are the so-called "process cartridges". In other words, each of the toner cartridges 215 (Y), 215 (M), 215 (C), and 215 (K) is an exchangeable process cartridge, and can be detachably attached to the image formation device 1.

In addition, antennae 216 (Y), 216 (M), 216 (C), and 216 (K) of the toner cartridges 215 (Y), 215 (M), 215 (C), and 215 (K), respectively, and antenna 217 of the image formation device 1 communicate with each other when necessary to send and receive data signals.

Figure 2:
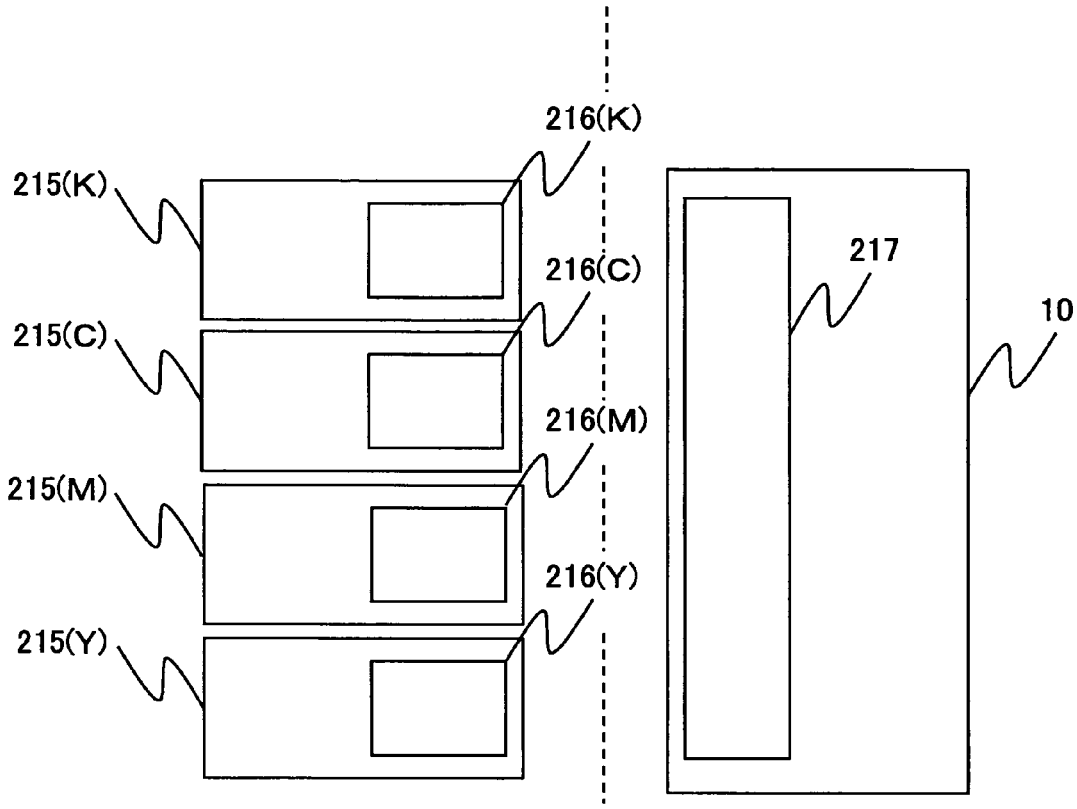
FIG. 2 is a schematic view illustrating the antennae 216 (Y), 216 (M), 216 (C), and 216 (K) of the toner cartridges 215 (Y), 215 (M), 215 (C), and 215 (K) and the antenna 217 of the image formation device 1.

FIG. 2 is a schematic view illustrating relationships between the antennae 216 (Y), 216 (M), 216 (C), and 216 (K) of the toner cartridges 215 (Y), 215 (M), 215 (C), and 215 (K) and the antenna 217 of the image formation device 1.

The antenna 217 of an engine controller 10 of the image formation device 1 is a part of the engine controller 10, which controls the image formation device 1. The four antennae 216 (Y), 216 (M), 216 (C), and 216 (K) communicate with the one antenna 217 of the image formation device 1.

Figure 3:
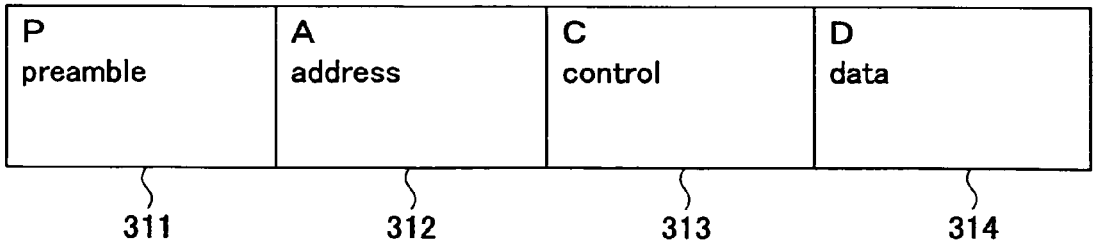
FIG. 3 is a diagram exemplifying a communication frame (signal) transmitted between the antennae 216 (Y), 216 (M), 216 (C), and 216 (K) of the toner cartridges 215 (Y), 215 (M), 215 (C), and 215 (K) and the antenna 217 of the image formation device 1.

FIG. 3 is a diagram exemplifying a communication frame (signal) transmitted between the antennae 216 (Y), 216 (M), 216 (C), and 216 (K) of the toner cartridges 215 (Y), 215 (M), 215 (C), and 215 (K) and the antenna 217 of the image formation device 1.

As shown in FIG. 3, the communication frame includes a preamble 311 used for frame synchronization, an address field 312 for storing addresses of a signal source and a signal destination, a control field 313 for storing types of frames, and a data field 314 for storing transmission data.

The toner cartridges 215 (Y), 215 (M), 215 (C), and 215 (K) and the engine controller 10 are assigned different addresses. Because the toner cartridges 215 (Y), 215 (M), 215 (C), and 215 (K) and the engine controller 10 communicate with each other with these different addresses by using the communication frame shown in FIG. 3, there is no cross-talk in the communications.

Figure 4:
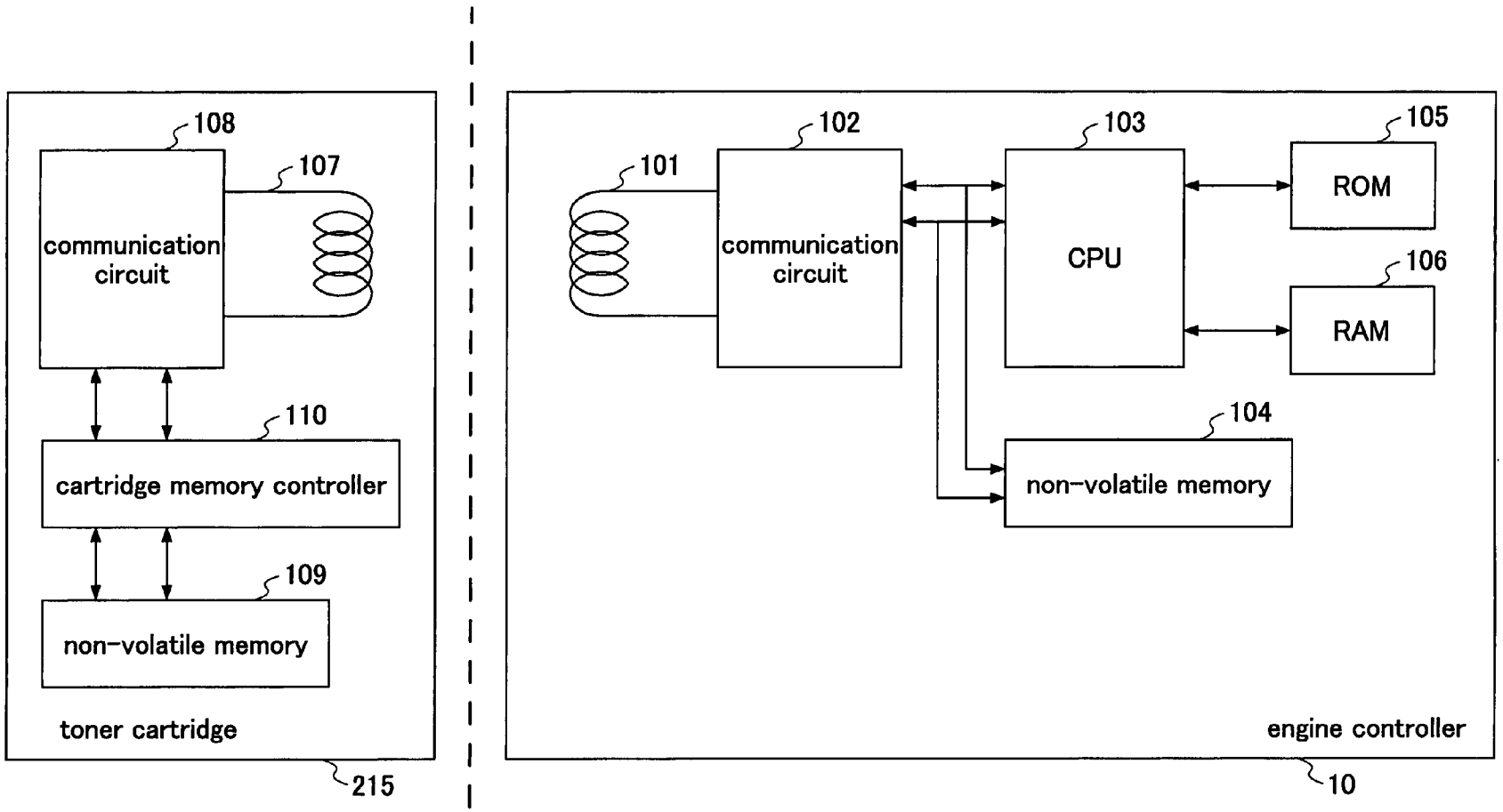
FIG. 4 is a block diagram exemplifying configurations of the engine controller 10 and the toner cartridge 215.

FIG. 4 is a block diagram exemplifying configurations of the engine controller 10 and the toner cartridge 215.

Since the toner cartridges 215 (Y), 215 (M), 215 (C), and 215 (K) have nearly the same structure, below, any one of the toner cartridges 215 (Y), 215 (M), 215 (C), and 215 (K) is simply referred to as a "toner cartridge 215".

In FIG. 4, the engine controller 10 includes an antenna 101, a communication circuit 102, a CPU (Central Processing Unit) 103, a ROM (Read Only Memory) 105, a RAM (Random Access Memory) 106, and a non-volatile memory 104. The toner cartridge 215 includes an antenna 107, a communication circuit 108, a non-volatile memory 109, and a cartridge memory controller 110.

The toner cartridge 215 can be detachably attached to the image formation device 1 at a position between the antenna 107 and the antenna 101, as shown by the dashed line in FIG. 4.

For example, the toner cartridge 215 and the engine controller 10 are connected through a radio link, namely, the toner cartridge 215 and the engine controller 10 perform wireless communications.

The engine controller 10 performs packet communications through the radio link to send instructions to the cartridge memory controller 110, and directs the cartridge memory controller 110 to read or write data in the non-volatile memory 109 of the toner cartridge 215.

In the above example, the transmission rate may be in a range from 9600 bps (bits per second) to 38400 bps.

Below, the components of the engine controller 10 are described.

The ROM 105 is a non-volatile memory, which stores control programs allowing the CPU 103 to control the image formation device 1.

The RAM 106 is a volatile memory, which stores temporary data generated when the CPU 103 executes the control programs stored in the ROM 105.

The non-volatile memory 104 of the engine controller 10 is a re-writable non-volatile memory, which stores back-up data of the non-volatile memory 109 of the toner cartridge 215, and stores document feed timing of the image formation device 1, document feeder stage setting, fusing temperature setting, and other data that ought to be retained even after the image formation device 1 is powered off.

With such a configuration, the engine controller 10 controls the overall operations of the image formation device 1. Further, as described below, the engine controller 10 also controls reading or writing data in the toner cartridge 215.

The toner cartridge 215 can be detachable attached to the image formation device 1, and the toner cartridge 215 and the engine controller 10 are connected through the radio link.

For example, the non-volatile memory 109 in the toner cartridge 215 may be an EEPROM (Electrically Erasable and Programmable ROM), which is able to retain stored data even when the image formation device 1 is powered off, or when the toner cartridge 215 is detached from the image formation device 1 and thus the power supply is stopped.

The data stored in the non-volatile memory 109 include power-off periods, cartridge identification number (for example, the manufacturing number of the toner cartridge 215, or other information for identifying the toner cartridge 215) which is used to determine whether the toner cartridge 215 has been exchanged after the door of the image formation device 1 is opened and closed, usage condition information such as starting date/time of usage of the toner cartridge 215 after the toner cartridge 215 is attached to the image formation device 1, toner end date/time used to confirm how long one cartridge can be used, counts of the starting date/time and toner end date/time used to confirm how many copies have been printed by using one cartridge, remaining toner quantity, toner near-end information for indicating how many more copies can be printed, the number of times of recycling after toner-end that is used to calculate the service life of the toner cartridge 215, and the number of copies after recycling used to predict the count at the time of the next toner-end.

In addition, the data stored in the non-volatile memory 109 further include the ID of the image formation device 1 to which the toner cartridge 215 is attached, software installed in the image formation device 1, version of image formation device, manufacture names, dealers, local usage area of image formation device used to collect information of the image formation device after the toner cartridge is recollected, toner color information used to confirm whether a correct color cartridge is attached, and others.

The control program stored in ROM 105 of the engine controller 10 controls the overall operations of the image formation device 1, and drives relevant components to read data from the non-volatile memory 109 of the toner cartridge 215 and to store the data in the non-volatile memory 104 in the main body of the image formation device 1.

For example, the control program is executed by the CPU 103 to drive the components of the engine controller 10 to operate, thus realizing functions of those components.

Figure 5:
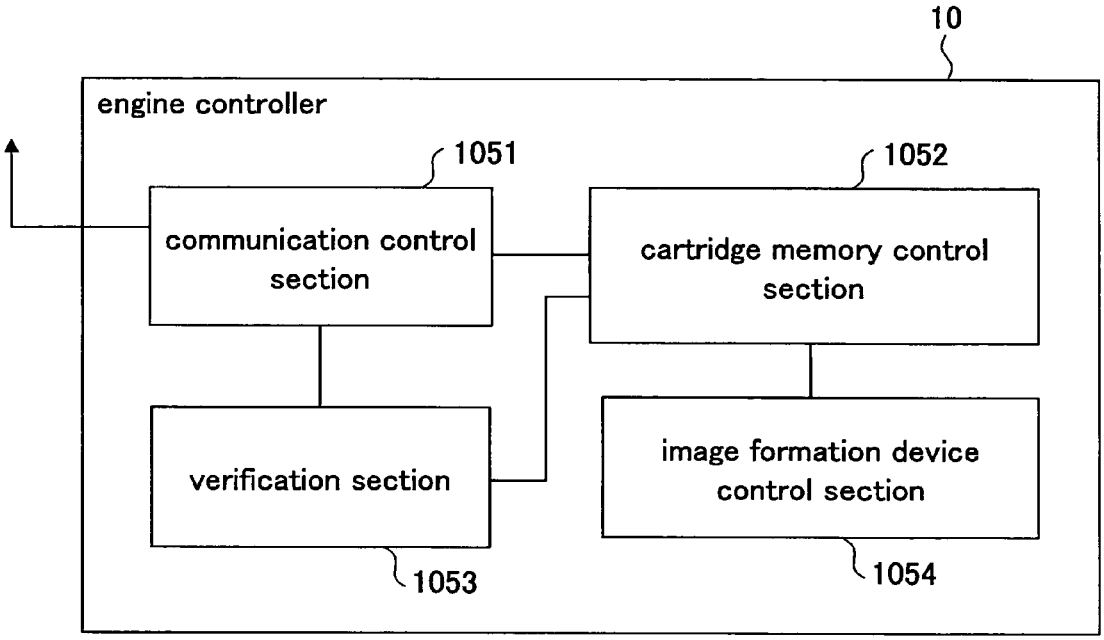
FIG. 5 is a block diagram exemplifying a configuration of functional sections of the engine controller 10.

FIG. 5 is a block diagram exemplifying a configuration of functional sections of the engine controller 10.

As shown in FIG. 5, the engine controller 10 may include a communication control section 1051 for controlling communications with the non-volatile memory 109 of the toner cartridge 215, a cartridge memory control section 1052 for controlling operations of reading data from and writing data in the non-volatile memory 109, a verification section 1053 configured to read data from the non-volatile memory 109 and verify reliability of the data, and an image formation device control section 1054 for controlling overall operations of the image formation device 1.

When reading predetermined data stored in the non-volatile memory 109, both the predetermined data and verification data stored in the non-volatile memory 109 are read out, and the verification section 1053 compares the verification data read out from the non-volatile memory 109 to verification data stored in the ROM 105 or RAM 106 to verify reliability of the data read from the non-volatile memory 109.

Figure 6:
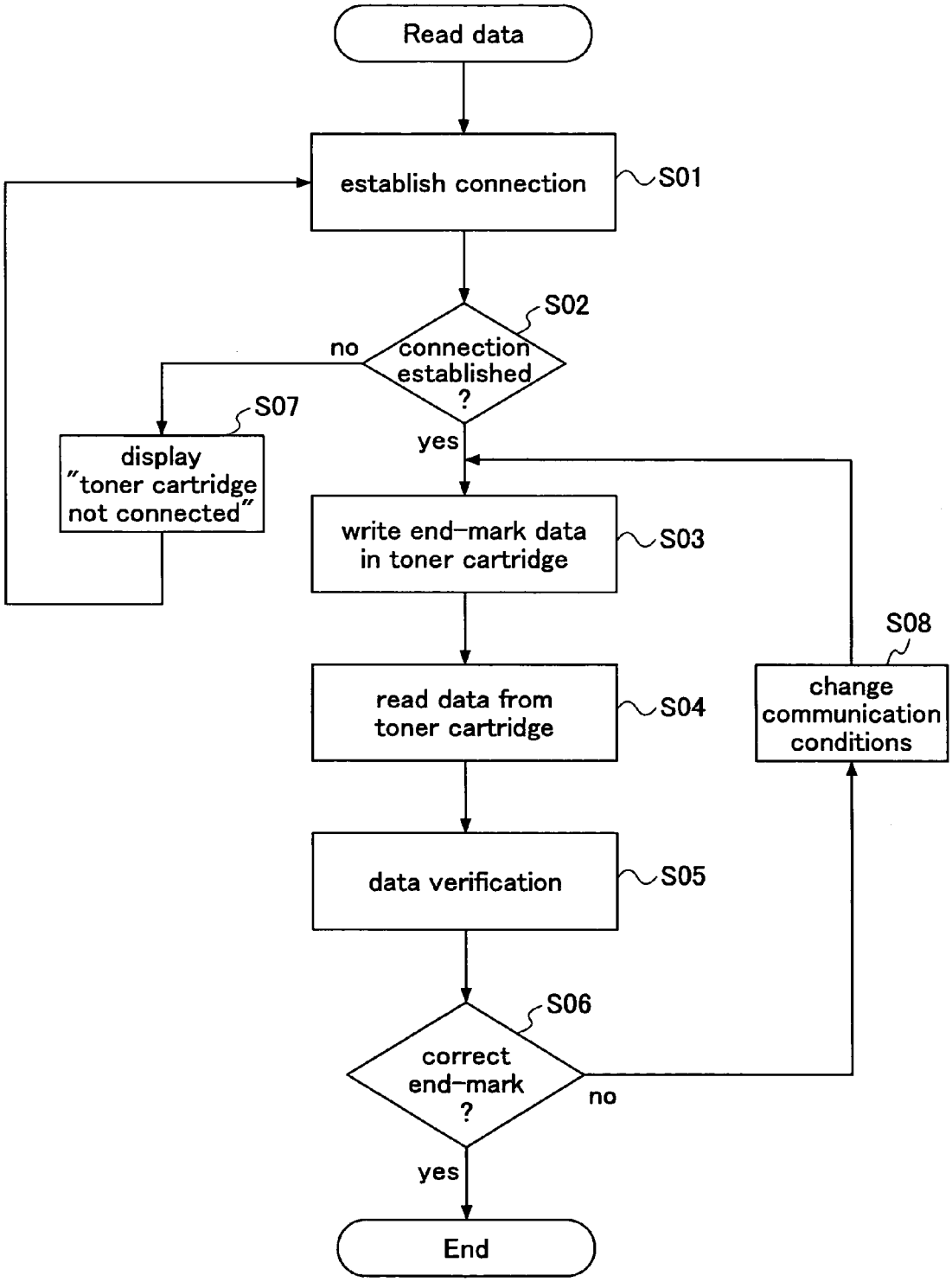
FIG. 6 is a flowchart illustrating operations of the engine controller 10 when the image formation device 1 is powered on for reading data from the non-volatile memory 109 of the toner cartridge 215, and storing the data to the non-volatile memory 104 on the main body of the image formation device 1.

FIG. 6 is a flowchart illustrating operations of the engine controller 10 when the image formation device 1 is powered on for reading data from the non-volatile memory 109 of the toner cartridge 215, and storing the data in the non-volatile memory 104 on the main body of the image formation device 1.

In step S01, when the image formation device 1 is powered on, the cartridge memory control section 1052 of the engine controller 10 transmits data to the communication circuit 108 of the toner cartridge 215 through the communication circuit 102. If a response from the communication circuit 108 is received, it means the connection between the image formation device 1 and the toner cartridge 215 is established.

In step S02, it is determined whether the connection with the toner cartridge 215 is established.

If a response from the communication circuit 108 is not received, indicating that the connection is not established, namely, the toner cartridge 215 is not connected, the routine proceeds to step S07.

If a response from the communication circuit 108 is received in step S02, it indicates that the connection with the toner cartridge 215 is established, and the routine proceeds to step S03.

In step S03, the cartridge memory control section 1052 of the engine controller 10 reads verification data stored in the ROM 105 or the RAM 106, and writes the verification data in the non-volatile memory 104. As shown below with reference to FIG. 7, the verification data may be written between an unused area and a usual data area; for this reason, the verification data is referred to as "end mark data".

Figure 7:
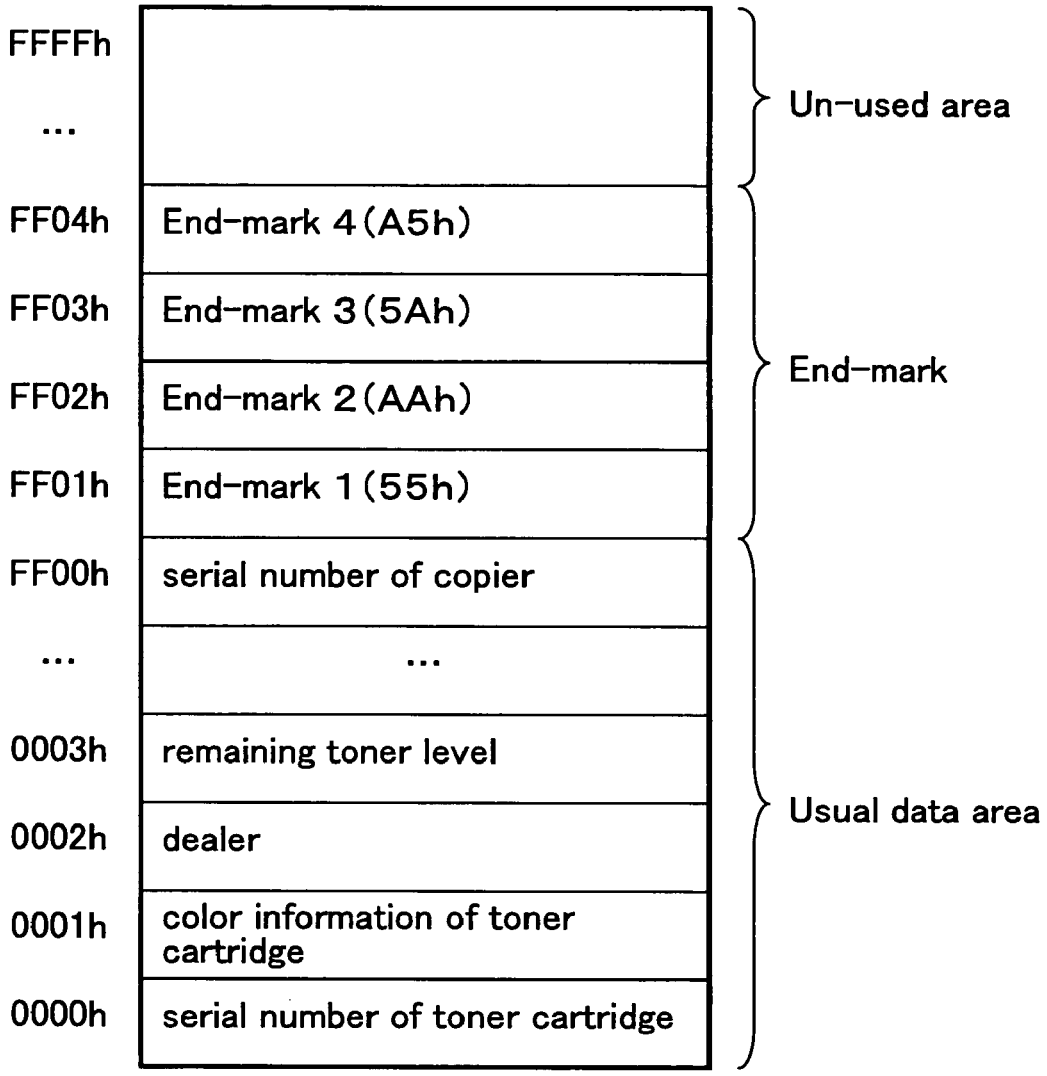
FIG. 7 is a diagram illustrating an address map of the non-volatile memory 109 in which the verification data (end mark data) are recorded.

FIG. 7 is a diagram illustrating an address map of the non-volatile memory 109 in which the verification data (end mark data) are recorded. As shown in FIG. 7, the non-volatile memory 109 has a capacity of 128 kilobytes (128 k×8 bytes), and a memory area from the address 0000h to the address FF00h is the usual data area, in which the serial number of the image formation device 1, the serial number of toner cartridge 215, color information of toner cartridge, and others are recorded. The memory area subsequent to the usual data area, specifically, from the address FF01h to the address FF04h is used to record the end mark data for data verification. In step S03, the cartridge memory control section 1052 writes data "55h", "AAh", "5Ah", "A5h" at address FF01h to FF04h, respectively.

The memory area subsequent to the end mark data area, specifically, from the address FF05h to the address FFFFh is an unused data area.

As shown below with reference to FIG. 7, the end mark data are written between the unused area and the usual data area, and for this reason, and can be any data.

In step S04, the cartridge memory control section 1052 of the engine controller 10 controls the cartridge memory controller 110 to read out the data stored in the non-volatile memory 109 of the toner cartridge 215.

The cartridge memory control section 1052 of the engine controller 10 reads out all of the data stored in the usual data area of the non-volatile memory 109 as shown in FIG. 4. At the same time, the cartridge memory control section 1052 also reads out the end mark data (verification data) written in the non-volatile memory 109 in step S03.

For example, when the cartridge memory control section 1052 is to read the data stored in the usual data area from the address 0000h to the address FF00h, the end mark data are assigned to be the four-byte data at addresses (FF01h to the FF04h) following the last data in the usual data area; hence, all the data stored from the address 0000h to the address FF04h are read out. The thus obtained data from the usual data area and the end mark data (verification data) are sent to the engine controller 10 through the communication circuit 108, and are loaded in the RAM 106.

In step S05, the verification section 1053 of the engine controller 10 compares the end mark data (verification data) which are read from the end mark positions of the non-volatile memory 109 and currently stored in the RAM 106 to a preset end mark value which is written in the ROM 105 or the RAM 106 in advance. In other words, the verification section 1053 of the engine controller 10 compares the received end mark data (verification data) to the preset end mark value stored in the ROM 105 or the RAM 106 to verify the received end mark data.

In step S06, if the received end mark data is correct, the routine is finished.

If the received end mark data is not correct, it is determined that the operation of writing the end mark data in step S03 and the operation of reading the end mark data in step S04 failed. Then the routine proceeds to step S08.

In step S07, a message is shown on an operational panel of the image formation device 1 to show that the toner cartridge 215 is not in position, and the routine waits until the toner cartridge 215 is in position and the connection with the toner cartridge 215 is established.

The failure detected in step S06 may be caused by various reasons, for example, probably, the connection between the engine controller 10 and the toner cartridge 215 is not well established, and the engine controller 10 and the toner cartridge 215 cannot communicate correctly.

Thus, in step S08, communication conditions between the engine controller 10 and the toner cartridge 215 are changed, if it is allowed.

Specifically, the transmission rate is lowered, or reading whole data at one time is changed to reading data in units of bytes.

After changing the communication conditions, operations in step S03 to step S06 are repeated to write the end mark data.

Following this procedure, it is possible to detect data loss or data garble occurring during communications, and perform the communications again when these errors are detected.

Figure 8:
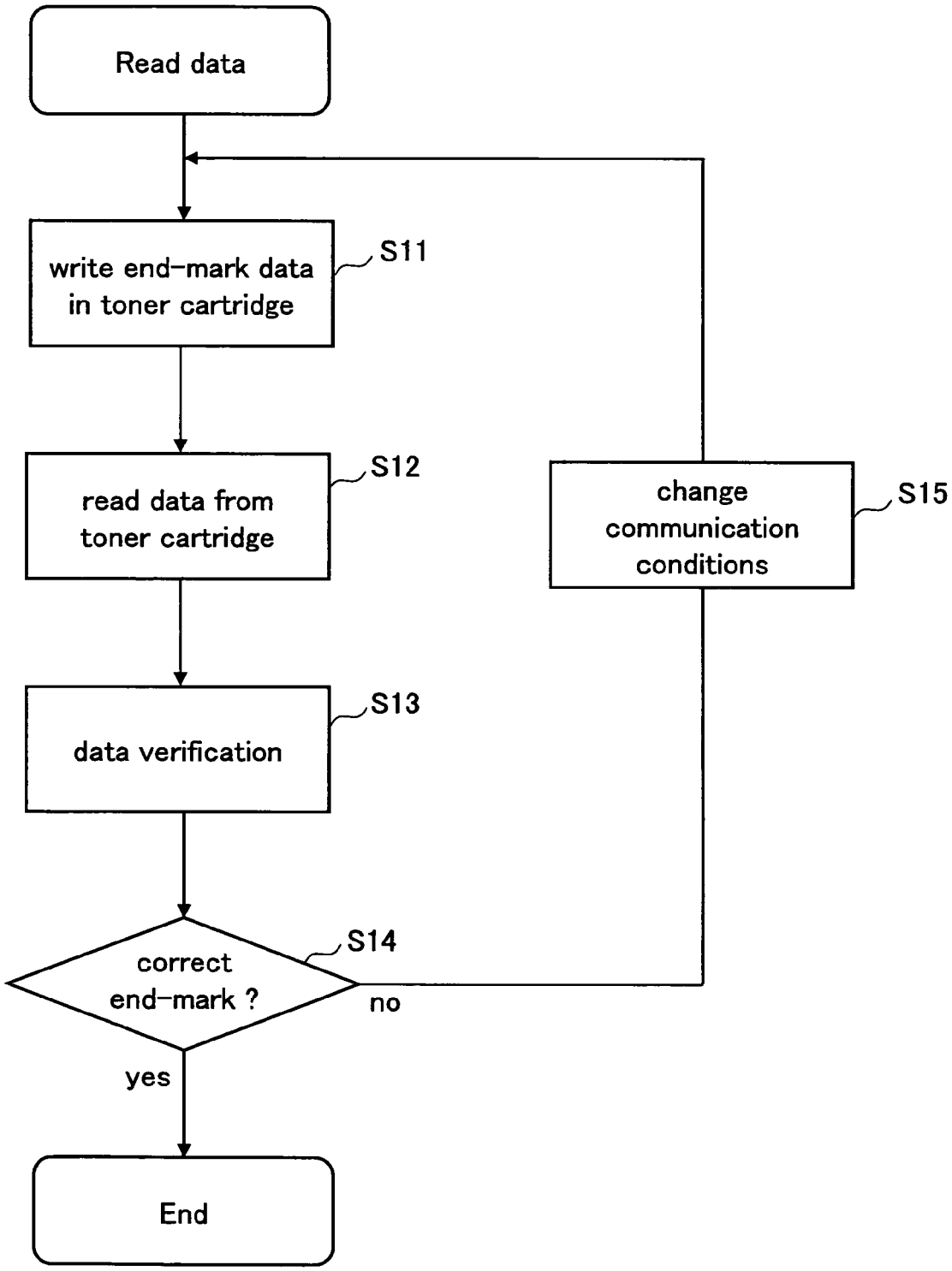
FIG. 8 is a flowchart illustrating operations of the image formation device 1 for reading data from the toner cartridge 215 when the image formation device 1 is in normal operations of image formation.

FIG. 8 is a flowchart illustrating operations of the image formation device 1 for reading data from the toner cartridge 215, when the image formation device 1 is in normal operations of image formation.

Figure 9:
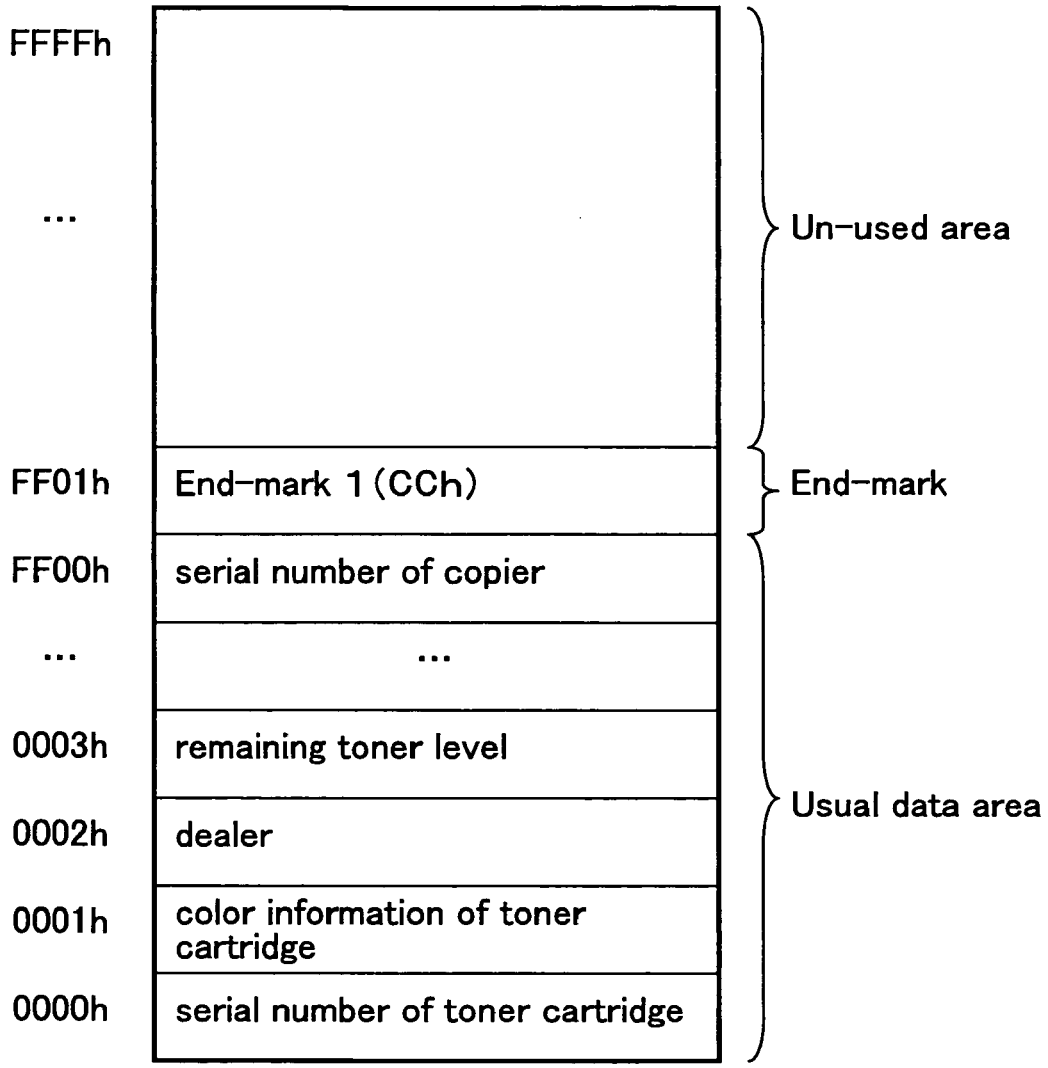
FIG. 9 is diagram illustrating an address map of the non-volatile memory 109 in which the verification data (end mark data) are recorded.

After confirming the remaining toner quantity, or other conditions of the image formation device 1, if it necessary to read the data from the non-volatile memory 109 of the toner cartridge 215, the engine controller 10 writes data, which is different from the data stored in the ROM 105, and that has been written to the non-volatile memory 104 of the engine controller 10 when the power is on, to a specified position of the non-volatile memory 109 (for example, at address FF01h in FIG. 9).

FIG. 9 is diagram illustrating an address map of the non-volatile memory 109 in which the verification data (end mark data) is recorded.

For example, the data written in the specified position of the non-volatile memory 109 is CCh. This data written to the specified position of the non-volatile memory 109 may be used as an end mark.

Generally, since when the image formation device 1 is in normal operations of image formation, the amount of data readable in each read operation is not large, here it is assumed that the end mark data just includes one set of data corresponding to, for example, image data to be read. However, as in the example in FIG. 6 showing operations at the time of power on, plural end mark data sets having different values can be read out at the same time, and in this case, it is possible to more reliably read the image data.

In FIG. 8, since steps following step S11 are the same as those in FIG. 6, explanations are omitted.

In FIG. 6 and FIG. 8, when the end mark data cannot be correctly read when reading other desired data, appropriate messages can be displayed to the user.

FIG. 10A and FIG. 10B are examples of messages displayed when the end mark data cannot be read correctly.

In FIG. 10A and FIG. 10B, messages are displayed to indicate that communication cannot be performed correctly. Receiving these messages, the user is prompted to clean the contact point between the image formation device 1 and the toner cartridge 215, and to attach the toner cartridge 215 in a correct position at the image formation device 1, to enable normal communications between the image formation device 1 and the toner cartridge 215.

First Modification

In the above, it is described that the toner cartridge 215 and the image formation device 1 are connected through a radio link, and the toner cartridge 215 and the image formation device 1 perform wireless communications.

Certainly, the toner cartridge 215 and the image formation device 1 may be connected through a cable.

Figure 11:
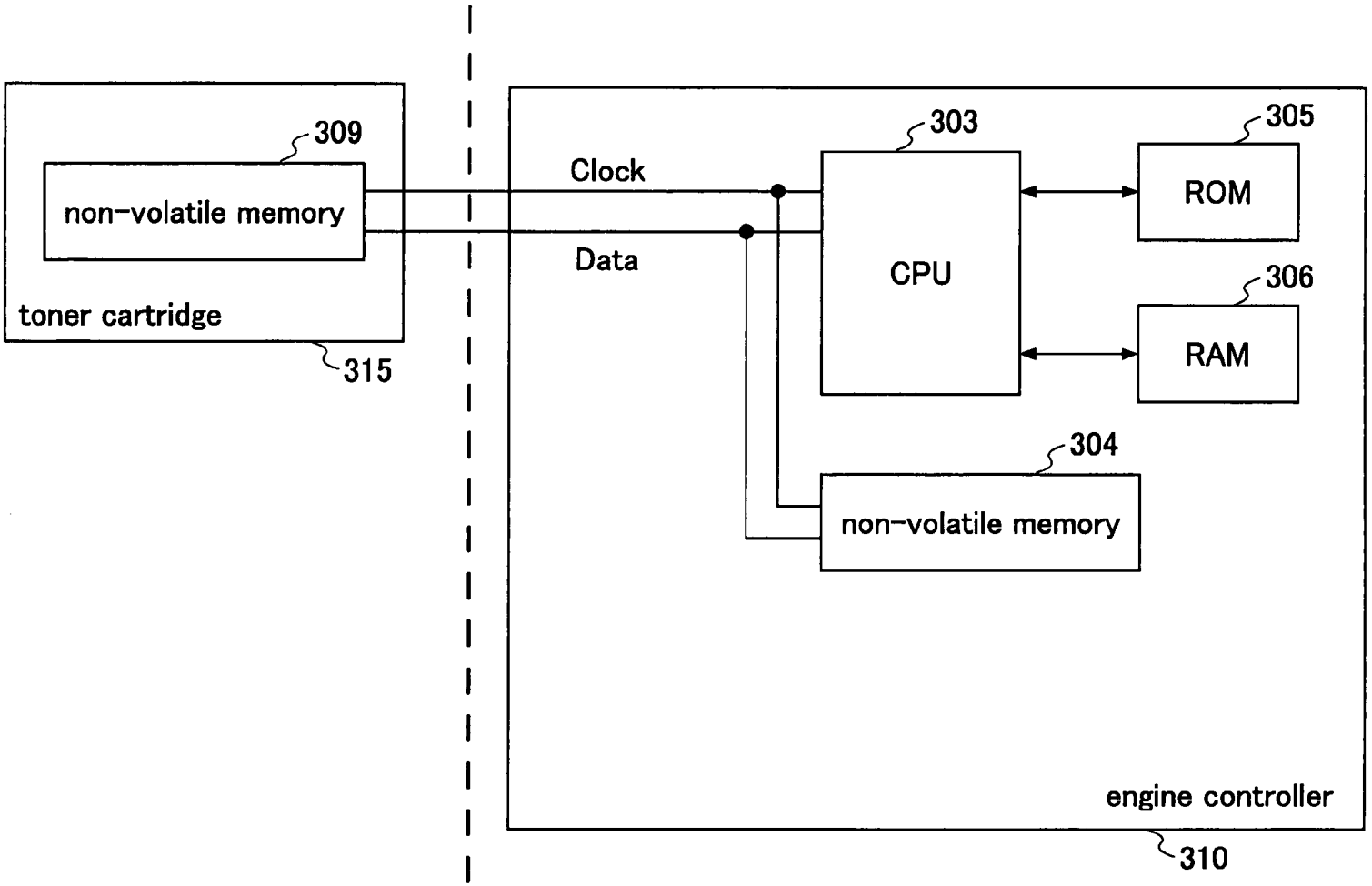
FIG. 11 is a block diagram exemplifying an engine controller 310 and a toner cartridge 315 connected through a cable.

FIG. 11 is a block diagram exemplifying an engine controller 310 and a toner cartridge 315 connected through a cable.

In FIG. 11, the engine controller 310 includes a CPU 303, a ROM 305, a RAM 306, and a non-volatile memory 304. The toner cartridge 315 includes a non-volatile memory 309.

The CPU 303 of the engine controller 310 performs clock synchronization communications through a clock line, a data line, or other communication lines to access the non-volatile memory 309 of the toner cartridge 315 to read or write data in the non-volatile memory 309 of the toner cartridge 315. For example, the frequency of the clock signal is in a range from 0.5 MHz to 2 MHz.

The toner cartridge 315 can be detachably attached to the image formation device, and the non-volatile memory 309 of the toner cartridge 315 is connected to the CPU 303 through the clock line, the data line, or other communication lines. When the toner cartridge 315 is detached from the image formation device, the communication bus is disconnected.

For example, the toner cartridge 315 is electrically connected to the image formation device 1 at a position indicated by the dashed line in FIG. 11 through metal contact points.

Except for the cable connection between the engine controller 310 and the toner cartridge 315, the system shown in FIG. 11 is the same as that shown in FIG. 4, hence, detailed explanations are omitted.

Second Modification

In the above, it is described that the end mark data written from the engine controller 10 is used as the verification data.

In the present invention, various kinds of data can be used as the verification data.

For example, data stored in the non-volatile memory 109 or the non-volatile memory 309 can be used as the end mark data. In this case, step S03 in FIG. 6 can be omitted.

For example, preset data can be stored at specified position in the non-volatile memory 109 or the non-volatile memory 309; alternatively, the serial number of the toner cartridge 315 can be used as the end mark data. As it is known, the serial number of the toner cartridge 315 does not change until the toner cartridge 315 is exchanged.

Figure 12:
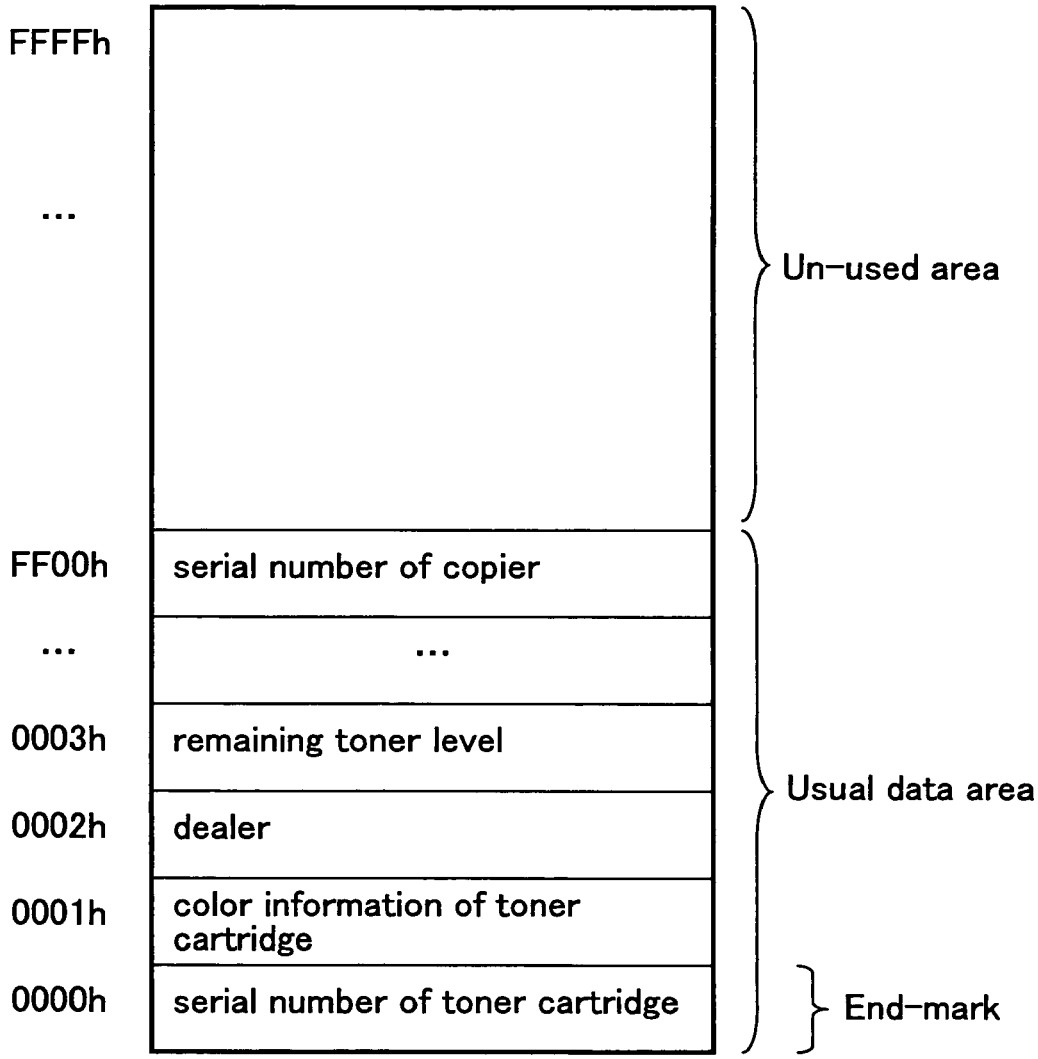
FIG. 12 is diagram illustrating an address map of the non-volatile memory 109 or 309 in which the verification data (end mark data) are recorded.

FIG. 12 is diagram illustrating an address map of the non-volatile memory 109 or 309 in which the verification data (end mark data) is recorded.

In this case, when the toner cartridge 315 performs communications with the image formation device 1 for the first time, the preset data stored at the specified position is read out plural times. If the obtained plural sets of data are in agreement with each other, it is determined that the operation of reading data from the non-volatile memory 109 or 309 has been correctly performed, and the obtained data are written in the non-volatile memory 104 or 304 of the image formation device 1. Then, the end mark data (verification data) read from the non-volatile memory 109 or 309 are compared to the data stored in the memory in the image formation device 1 to confirm whether the reading operation has been performed correctly.

Third Modification

In the above, it is described that it is preferable that the end mark data be at a position immediately after the usual data area, from which desired information is read out. In this way, the data reading area in the memory is not too large when successively reading data from the non-volatile memory 109 or the non-volatile memory 309. However, the position of the end mark data is not limited to the end of the usual data area. For example, in the course of successively reading data from the non-volatile memory 109 or the non-volatile memory 309, plural end mark data sets may be inserted at nearly regular intervals; thus, reading of the plural end mark data sets can be performed at nearly regular intervals. In this case, the number of end mark data sets is dependent on the amount of the data that ought to be read. For example, when only one or a small number of data sets ought to be read, only one end mark data set is sufficient, whereas when a large amount of data ought to be read successively, the number of the end mark data sets can be increased. Instead of increasing the number of the end mark data sets, the same end mark data set can be read for multiple times. Nevertheless, it is preferable to use multiple end mark data sets, and assign different values to the multiple end mark data sets. In doing so, it is possible to improve reliability of the data regardless of the amount of the data.

Because generally data in the non-volatile memory 109 or the non-volatile memory 309 are read and are transmitted to the RAM 106 or RAM 306 on the main body at the time of power on, it is preferable to use multiple end mark data sets to improve reliability. Further, the end mark data may be changed each time a writing operation is performed to verify whether writing operations are performed correctly. In this case, for example, the end mark data written in the non-volatile memory 109 or the non-volatile memory 309 may be also stored in the RAM 106 or RAM 306 of the image formation device 1 in advance, and when the end mark data are read from the non-volatile memory 109 or the non-volatile memory 309, the end mark data in the RAM 106 or RAM 306 may also be read out and are compared to the end mark data read from the non-volatile memory 109 or the non-volatile memory 309.

Fourth Modification

In the above, it is described that when errors are detected, the communication conditions are changed, and data are read and transmitted again. However, when the communication includes DMA transfer, interruption transfer, or polling transfer, one or more of them may be changed, instead of changing the communication conditions.

Conversely, when the transmission rate cannot be slowed any more, or data are read in units of bytes, because the communication circumstance cannot be improved by changing the communication conditions, signals can be sent to the main body of the image formation device 1 multiple times, instead of changing the communication conditions.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

In the above, a toner cartridge is used as an example for description, but the present invention is not limited to this. The cartridge of the present invention may be a process cartridge, or a toner cartridge, or others.

This patent application is based on Japanese Priority Patent Application No. 2005-044526 filed on Feb. 21, 2005, the entire contents of which are hereby incorporated by reference.

What is claimed is:

1. An image formation device that reads data from or writes data in a memory unit provided in a cartridge detachably attached to the image formation device, said image formation device comprising:

a cartridge memory controller configured to control operations of reading data from the memory unit and writing data in the memory unit from a side of the image formation device; and a verification unit configured to verify reliability of the data read from the memory unit according to instructions from the cartridge memory controller;

wherein whenever the cartridge reads predetermined data from the memory unit according to the instructions of the cartridge memory controller, the cartridge reads out both the predetermined data and verification data stored in the memory unit, and sends the predetermined data and verification data to the image formation device, and the verification unit compares the verification data read out according to the instructions of the cartridge memory controller to other verification data stored in a main body of the image formation device to verify reliability of the data read from the memory unit.

2. The image formation device as claimed in claim 1, wherein the verification data include data specific to the cartridge stored in the memory unit.

3. The image formation device as claimed in claim 2, wherein when the cartridge is put into use for the first time, the data specific to the cartridge is read out plural times, and the data specific to the cartridge is adopted to be the verification data when the data sets read from the cartridge plural times are in agreement with each other.

4. The image formation device as claimed in claim 1, wherein the verification data are stored at a predetermined position in the memory unit.

5. The image formation device as claimed in claim 1, wherein the verification data are read from the main body of the image formation device in advance for each read operation.

6. The image formation device as claimed in claim 1, further comprising:

a communication unit that is connected to a communication unit in the cartridge through a communications line, wherein when the read-out verification data are different from the verification data stored in the main body of the image formation device, the cartridge memory controller directs the main body of the image formation device to send the predetermined data and the verification data again to the cartridge via the communications line.

7. The image formation device as claimed in claim 6, wherein the communication line is a radio link.

8. A cartridge able to be detachably attached to an image formation device, comprising:

a memory unit;

a memory controller configured to control operations of reading data from the memory unit and writing data in the memory unit; and a communication unit configured to communicate with a main body of the image formation device;

wherein verification data are stored in the memory unit, according to instructions from the main body of the image formation device of reading predetermined data from the memory unit, the memory controller reads out both the predetermined data and the verification data, and the communication unit sends the predetermined data and verification data to the main body of the image formation device.

9. The cartridge as claimed in claim 8, wherein when the cartridge receives a response from the main body of the image formation device indicating that the verification data received by the image formation device is different from the verification data stored in the main body of the image formation device, or a message from the main body of the image formation device requesting re-sending the verification data, the cartridge sends the predetermined data and the verification data to the main body of the image formation device again with a different communications condition and a different communications procedure.

10. The cartridge as claimed in claim 8, wherein when the cartridge receives a response from the main body of the image formation device indicating that the verification data received by the image formation device is different from the verification data stored in the main body of the image formation device, or a message from the main body of the image formation device requesting re-sending the verification data, the cartridge sends the predetermined data and the verification data to the main body of the image formation device again plural times under the same communications condition.

11. The image formation device as claimed in claim 1, wherein:

the verification unit compares the verification data read out to other verification data stored in a main body of the image forming device to verify reliability of the data read from the memory unit, each time data is read from the memory.

12. An image forming device that reads data from or writes data in a memory of a container attached to the image formation device, comprising:

a memory controller configured to control reading of data from the memory and writing data in the memory; and a processor configured to verify reliability of the data read from the memory, the data read from the memory including predetermined data and verification data, and the processor configured to compare the verification data read from the memory with other verification data stored in a main body of the image forming device to verify reliability of the data read from the memory, each time data is read from the memory.

* * * * *